US006736666B2

(12) United States Patent
Yu

(10) Patent No.: US 6,736,666 B2
(45) Date of Patent: May 18, 2004

(54) ELECTRICAL PLUG HAVING A PULL RING

(76) Inventor: Jeff Yu, 1101 S. Winchester Blvd., #D146, San Jose, CA (US) 95128

( * ) Notice: Subject to any disclaimer, the term of this patent is extended or adjusted under 35 U.S.C. 154(b) by 0 days.

(21) Appl. No.: 10/107,116

(22) Filed: Mar. 28, 2002

(65) Prior Publication Data

US 2003/0186593 A1 Oct. 2, 2003

(51) Int. Cl.[7] ..... H01R 13/00
(52) U.S. Cl. ..... 439/484
(58) Field of Search ..... 439/483, 484, 439/477, 371, 372, 108, 358, 692, 694

(56) References Cited

U.S. PATENT DOCUMENTS 1,568,995 A * 1/1926 Benjamin ..... 439/484
3,160,947 A * 12/1964 Sunderlin ..... 29/764
3,431,535 A * 3/1969 Munyen ..... 439/484
4,927,376 A * 5/1990 Dickie ..... 439/484
5,057,036 A * 10/1991 Dickie ..... 439/484
5,062,803 A * 11/1991 Howard et al. ..... 439/160
5,409,397 A * 4/1995 Karman ..... 439/484
5,567,181 A * 10/1996 Lentz et al. ..... 439/694
5,679,014 A * 10/1997 Lan-Jen ..... 439/160
6,089,924 A * 7/2000 Wang ..... 439/694

* cited by examiner

*Primary Examiner*—Tulsidas C. Patel

(57) ABSTRACT

This invention relates to electrical plugs capable of being easily removed from their associated receptacles with the aid of a pull ring. This improved pull ring is either pulled or pushed only in the direction that is perpendicular to the prong side of an electrical plug whereby making the storage and operation of the pull ring much easier to operate than the typical pull-ringed electrical plug arrangements that are currently available.

11 Claims, 2 Drawing Sheets

ELECTRICAL PLUG HAVING A PULL RING

TECHNICAL FIELD

The present invention relates to electrical plugs. In particular, this invention relates to electrical plugs capable of being easily removed from their associated receptacles with the aid of a pull ring.

BACKGROUND ART

Pull rings are fairly commonplace for small items such as electrical plugs. They make easier the removal of the electrical plugs from their inserted positions. The pull ring for an electrical plug usually rotates or pivots from a locked or storage position that is disposed around the rim of the plug to its working position located vertically above the plug center.

Several disadvantages are known for the use of these typical pull rings. To allow the rotational or pivotal movement about the plug, a pull ring is limited in its width or its diameter. Metallic materials (e.g., hardened metallic wires) are usually used for such rings because of their ability to withstand the pulling force required to remove the plug from its inserted receptacle. Although they do serve the plug removal function, the thin diameter of these metallic pull rings tends to cause the rings to sink into the pulling fingers and make the finger-pulling action painful and therefore extremely unpleasant. Also, over time, consistent uses of these metallic pull rings may present users with the danger of electric shocks.

Another disadvantage is the difficulty due to the ring's thinness as one unlocks and rotates the ring to prepare for use from its storage position to its operating position especially when the plug is located in a setting that is hard to reach and see. Rambling manipulation of the pull rings in such difficult spots is both challenging and frustrating. The same difficulty goes to the reverse process as one rotates the pull ring from its operating position back to its locking position. Yet another disadvantage for the typical pull rings is that they are fixedly attached to their plugs. In this manner, it makes life cumbersome for those who work with the plugs but do not prefer the use of pull rings.

Thus, there is a continuing need for an improved pull ring for an electrical plug where the pull ring is easily stored, readied, removed, comfortably used and all without the risk of electrical shock.

SUMMARY OF THE INVENTION

The present invention is an electrical plug having a plug body that has a prong side, a generally flat side opposite to the prong side and a side surface connecting the two sides. Two channels recessed into the side surface perpendicular to the two sides, disposed generally opposite to each other on the plug body, and these channels are configured in a way to receive two T-shaped tongues, one in each channel, whereby allowing the tongues to slide inside the channels. These T-shaped tongues are connected and joined into a pull ring by a connecting piece, this piece making with the tongues two angles each being equal to or greater than 90 degrees. The connecting piece may be arc-shaped and having a length that generally runs across the generally flat side.

The pull ring is preferably made of hardened plastics with some elasticity. Therefore, when the connecting piece is pushed toward the prong side, the T-shaped tongues slide in the channels toward the prong side into its storage position, and if pulled into the operating position, the tongues slide in the channels toward the generally flat side. The channels are configured in a way such that the T-shaped tongues can move freely inside but cannot be pulled out of there in a direction perpendicular to and away from the prong side because of a stop placed in each channel near the generally flat side.

When the connecting piece is pushed in a direction perpendicular to and toward the prong side into its storage position, the T-shaped tongues slide through the entire length of the channels, stopped by the junctures where the tongues and the connecting piece of the pull ring meet, and the heads of the tongues extrude out of the channels on the prong side. Any extra force applied to the connecting piece toward the prong side to remove the pull ring from the plug will cause the heads of the tongues to swing in a direction generally parallel to and away from the prong side whereby allowing the tongues to move out of the channels.

BRIEF DESCRIPTION OF THE DRAWINGS

A better understanding of the present invention can be obtained by considering the following detailed description taken together with the accompanying drawings that illustrate preferred embodiments of the present invention in which.

DETAILED DESCRIPTION OF THE PREFERRED EMBODIMENTS

Reference will now be made in detail to the preferred embodiments of the present invention, examples of which are illustrated in the accompanying drawings. While the invention will be described in conjunction with the preferred embodiments, it will be understood that they are not intended to limit the invention to those embodiments.

Figure 2:
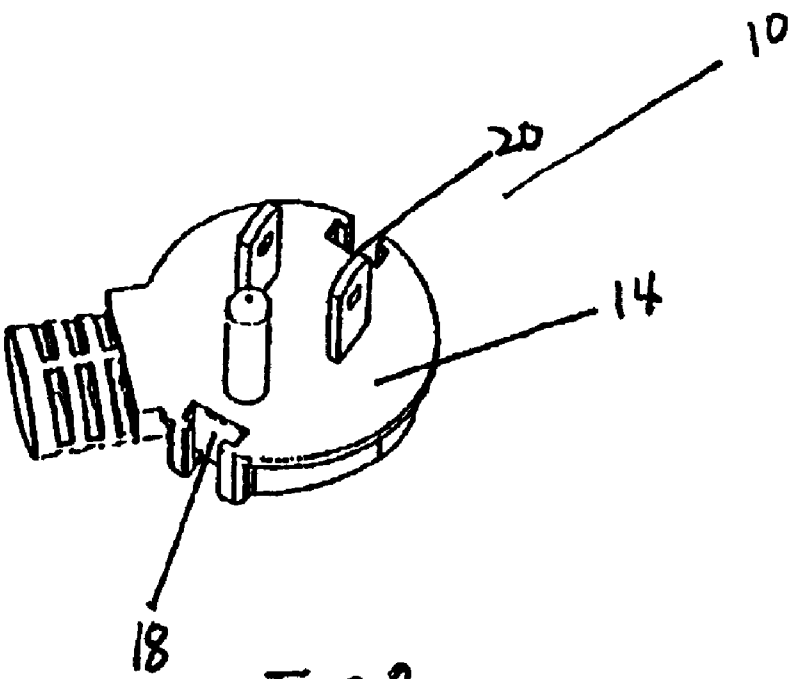
FIG. 2 is a perspective view of the electrical plug embodiment in accordance with the present invention showing its prong side.
Figure 1:
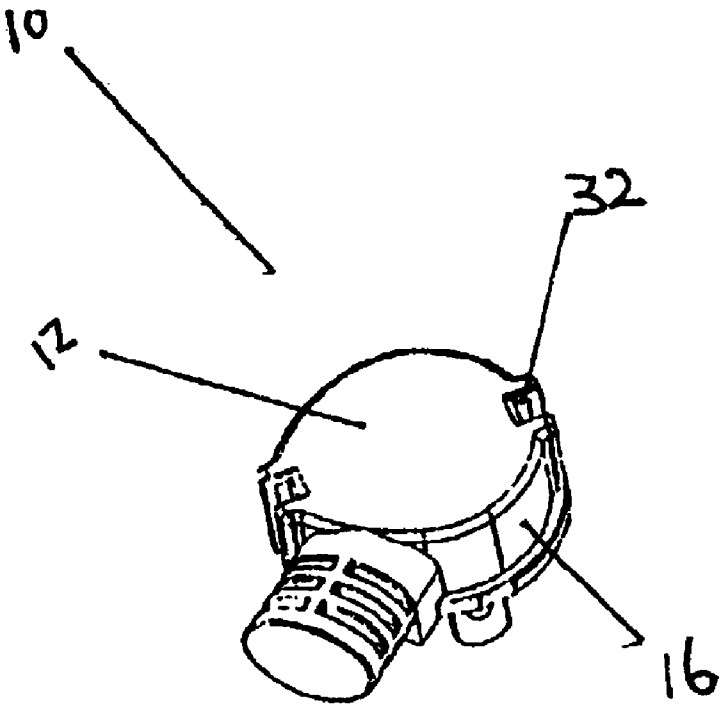
FIG. 1 is a perspective view of an electrical plug embodiment in accordance with the present invention showing its generally flat side.

Referring now to FIG. 1 and FIG. 2, a preferred embodiment of an electrical plug 10 in accordance with the present invention are provided in perspective views showing a generally flat side 12, a prong side 14 and a side surface 16. The generally flat side 12 and the prong side 14 are in parallel to each other whereas the side surface 16 connects the two sides 12,14 together. The side surface 16 itself may have different configurations whereby making possible the entire electrical plug 10 to have different shapes, for example, circular, rectangular, poly-sided, etc. Two channels 18,20 are recessed into the side surface 16 of the electrical plug 10. They are located generally opposite to each other on the side surface 16 of the plug 10 and disposed in a direction that is perpendicular to the two sides 12,14. Preferably, the two sides 12,14, the side surface 16 and the channels 18,20 are molded by plastics.

Figure 4:
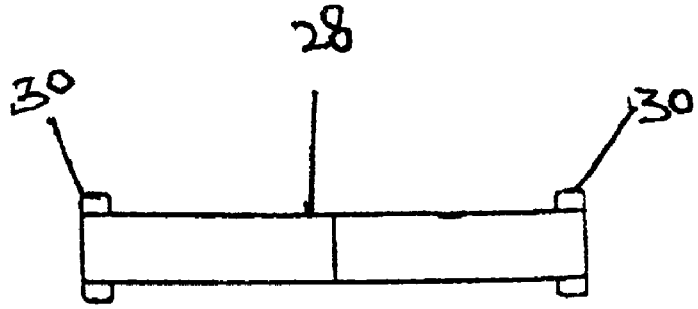
FIG. 4 is a top view of the pull ring embodiment in accordance with the present invention.
Figure 3:
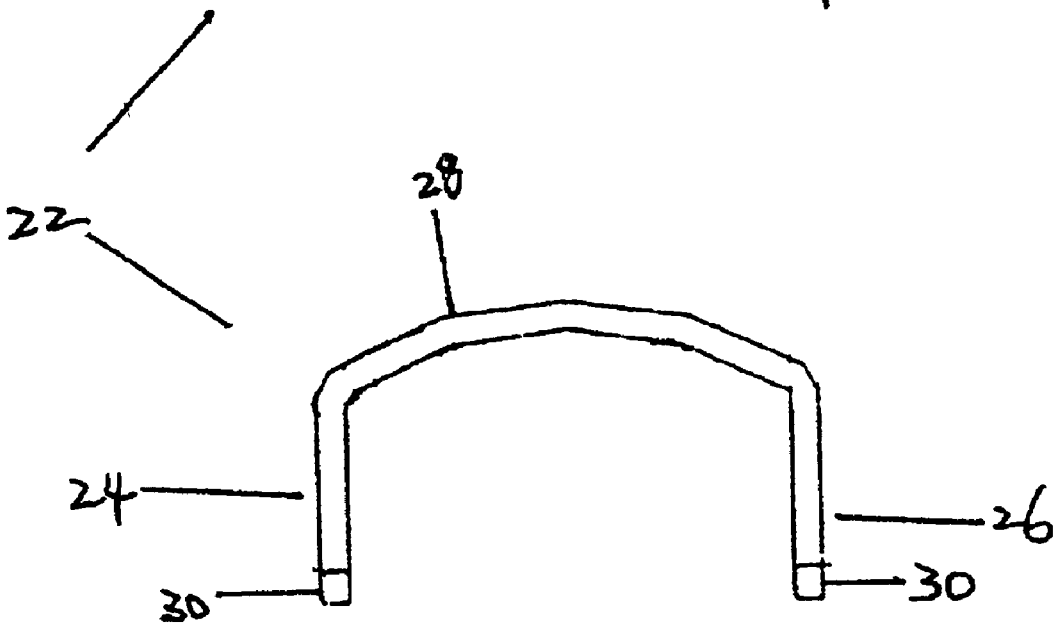
FIG. 3 is a side elevational view of a pull ring embodiment in accordance with the present invention.

Referring now to FIG. 3 and FIG. 4, a preferred embodiment of a pull ring 22 is shown in its side elevational and top views. The pull ring 22 has two T-shaped tongues 24,26 and a connecting piece 28, and it has a width that is comfortable for fingers to pull, preferably, at least over 5 millimeters.

Each of the T-shaped tongues 24,26 has a head 30. The pull ring 22 may be of a different color from that of the rest of the plug 10 for ease of identification. Also, the pull ring 22 may be made of the plastics similar to that of the plug 10. It is preferable, however, that the plastics selected for the pull ring 22 is not only hardened but with some elasticity as well. The use of plastics eliminates the risk of electrical shock due to overuse. The T-shaped tongues 24,26 make two angles equal to or greater than 90 degrees with the connecting piece 28 whereby allowing an arc-like configuration for the connecting piece 28; however, other configurations are also possible as long as in its storage position some space is allowed between the connecting piece 28 and the generally flat side 12.

Operationally, the T-shaped tongues 24,26 slide inside the two channels 18,20. To get to the operating position for the pull ring 22, fingers may be used to pull the connecting piece 28 in a direction perpendicular to and away from the prong side 14. The channels 18,20 are configured in a way such that the T-shaped tongues 24,26 can move freely inside but cannot be pulled out of there because of a stop 32 placed in each channel 18,20 near the generally flat side 12. This pulling of the pull ring 22 in a single direction to ready the pull ring 22 for use is much easier to provide than the rotational motion one has to negotiate for the typical pull ring arrangements especially in settings that may be hard to reach and see and in settings only maneuverable with a few fingers. Any further pulling force asserted by the fingers in the same direction while in the operating position will cause the electrical plug 10 to dislodge from its inserted receptacle (not shown). The fairly wide pull ring 22 reduces the pain and the unpleasant experience for the fingers as they are used to pull the plug 10 out.

When not in use, the pull ring 22 is stored on the electrical plug 10 in accordance with the present invention by pushing the connecting piece 28 of the pull ring 22 in a direction perpendicular to and towards the prong side 14. The T-shaped tongues 24,26 will traverse inside the channels 18,20 toward the prong side 14 and stops its sliding motion into its storage position when the junctures, where the tongues 24,26 and the connecting piece 28 meet, hit the edge of the generally flat side 12 of the plug 10. In this position, the heads 30 of the tongues 24,26 extrude out of the channels 18,20 on the prong side 14 and preferably the connecting piece 28 of the pull ring 22 is disposed on top of the generally flat side 12 with a slight arc. This slight arc may readily allow fingers to wrap around the pull ring 22 to initiate the pull ring 22 movement from the its current storage position to its operating postion. This slight arc or generally speaking, some space between the connecting piece 28 and the generally flat side 12 makes readying for the use of the pull ring 22 much easier than the typical unlock and rotate process. Because the heads 30 are now outside of the channels 18,20, any extra pushing force applied to the connecting piece 28 toward the prong side 14 would remove the pull ring 22 from the plug 10. This further push would elastically cause the heads 30 of the T-shaped tongues 24,26 to swing generally parallel to and away from the prong side 14 whereby allowing the tongues 24,26 to move out of the channels 18,20 and be removed whenever pull rings are not preferred by the users.

While the present invention has been described in terms of preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What I claim is:

1. An electrical plug comprising:

a plug body having a prong side, a generally flat side and a side surface, said prong side and the generally flat side being in parallel to each other whereas said side surface being disposed for connecting the two sides;

said side surface further having two channels recessed in a direction generally perpendicular to the two sides; and a pull ring having two T-shaped tongues each having a head, and a connecting piece joining the two T-shaped tongues, said connecting piece making angles equal to or greater than 90 degrees with the two T-shaped tongues, said two T-shaped tongues being further configured to slide freely inside the two channels on said side surface between a storage position where the head of the each T-shaped tongue being stopped in its sliding motion toward the generally flat side by a stop near the generally flat side and an operating position where the slide motion toward the prong side being stopped by the pull ring and where the head of each T-shaped tongue extruding outside of the two channels near the prong side.

2. The plug according to claim 1 wherein the connecting piece has a width of at least 5 millimeters.

3. The plug according to claim 1 wherein the electrical plug body is generally circular in shape.

4. The plug according to claim 1 wherein the connecting piece is made of hardened plastics with some elasticity.

5. The plug according to claim 1 wherein the pull ring has a color different from that of the plug body.

6. An electrical plug comprising:

a plug body having a prong side, a generally flat side and a side surface, said prong side and the generally flat side being in parallel to each other whereas said side surface being disposed for connecting the two sides;

said side surface further having two channels recessed in a direction generally perpendicular to the two sides; and pull ring means in operative relationship with said two channels only in a direction perpendicular to said prong side, said pull ring means being configured to operate slidably along the two channels of said side surface between a storage position where allowing some space between the generally flat side and said pull ring means and an operating position where allowing significantly larger space between the generally flat side and said pull ring means.

7. The plug according to claim 6 wherein the pull ring means forms a slight arc over the generally flat side of the plug body in the storage position.

8. The plug according to claim 6 wherein the electrical plug body is generally circular in shape.

9. The plug according to claim 6 wherein the pull ring means is made of hardened plastics with some elasticity.

10. The plug according to claim 6 wherein the pull ring N means has a color different from that of the plug body.

11. A method for moving a pull ring on an electrical plug between a storage position and an operating position, the steps comprising:

Pulling the pull ring removably attached to electrical plug in a direction perpendicular to and away from a prong side of a plug body, said body further having a generally flat side and a side surface, said prong side and the generally flat side being in parallel to each other whereas said side surface being disposed for connecting the two sides; said side surface further having two channels recessed in a direction generally perpendicular to the two sides, the pull ring having two T-shaped tongues each having a head, and a connecting piece joining the two T-shaped tongues, said connecting piece making angles equal to or greater than 90 degrees with the two T-shaped tongues, said two T-shaped tongues being further configured to slide freely inside the two channels on said side surface where the head of the each T-shaped tongue being stopped in its sliding motion toward the generally flat side by a stop near the generally flat side; and Pushing the pull ring in a direction perpendicular to and toward the prong side of the plug body where the slide motion toward the prong side being stopped by the pull ring and where the head of each T-shaped tongue extruding outside of the two channels near the prong side.

* * * * *